US006496080B1

(12) United States Patent
Ishiura et al.

(10) Patent No.: US 6,496,080 B1
(45) Date of Patent: Dec. 17, 2002

(54) DIELECTRIC WAVEGUIDE NONRECIPROCAL CIRCUIT DEVICE WITH A NON-INTERFERING MAGNETIC MEMBER SUPPORT

(75) Inventors: Yutaka Ishiura, Kyoto (JP); Hiromu Tokudera, Nagaokakyo (JP); Kei Matsutani, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/538,838

(22) Filed: Mar. 30, 2000

(30) Foreign Application Priority Data

Mar. 30, 1999 (JP) ..... 11-088959

(51) Int. Cl.[7] ..... H01P 1/383
(52) U.S. Cl. ..... 333/1.1; 333/24.2
(58) Field of Search ..... 333/1.1, 24.2

(56) References Cited

U.S. PATENT DOCUMENTS 4,034,377 A 7/1977 Knox et al. ..... 333/1.1 X
5,781,086 A * 7/1998 Kato et al. ..... 333/1.1 X

FOREIGN PATENT DOCUMENTS

EP 0709912 5/1996

* cited by examiner

*Primary Examiner*—Justin P. Bettendorf
(74) *Attorney, Agent, or Firm*—Keating & Bennett, LLP

(57) ABSTRACT

A dielectric nonreciprocal circuit device, which has satisfactory nonreciprocal characteristics obtained by improving the structure of a part supporting magnetic members, is incorporated in a radio device. The dielectric nonreciprocal circuit device has an arrangement such that supporting members for supporting the magnetic members are not located where the magnetic members are abutted against dielectric strips or where the magnetic members are disposed in close proximity to the dielectric strips.

19 Claims, 8 Drawing Sheets

DIELECTRIC WAVEGUIDE NONRECIPROCAL CIRCUIT DEVICE WITH A NON-INTERFERING MAGNETIC MEMBER SUPPORT

BACKGROUND OF THE INVENTION

1. Field of the Invention

The present invention relates to dielectric waveguide nonreciprocal circuit devices and radio devices using the same.

2. Description of the Related Art

Conventional circulators using nonradiative dielectric waveguides (hereinafter referred to as NRD waveguides) have been disclosed in Japanese Unexamined Patent Publication No. 8-181509, Japanese Unexamined Patent Publication No. 9-181506, and Japanese Unexamined Patent Publication No. 9-186507.

FIG. 11 shows the basic structure of a circulator using the above NRD waveguide. In FIG. 11, reference numerals 1 and 2 show an upper conductive plate and a lower conductive plate, respectively. Three dielectric strips indicated by reference numerals 3, 4, and 5 are disposed between the two conductive plates 1 and 2 to form NRD waveguide. Magnetic members 6 and 7 are disposed at positions where the three dielectric strips 3, 4, and 5 approach each other. Magnets 8 and 9 are disposed at positions on approach sides of the magnetic members 6 and 7. The upper and lower conductive plates 1 and 2 are disposed between the magnetic member 6 and the magnet 8 and between the magnetic member 7 and the magnet 9, respectively. With this arrangement, a DC bias magnetic field is applied. The DC magnetic field is applied to the magnetic members 6 and 7 in directions vertical to the surfaces of the magnetic members 6 and 7, and a magnetic field component of a high frequency parallel to the DC magnetic field is applied. In this situation, due to the ferrimagnetic characteristics of the magnetic members 6 and 7, the planes of polarization rotate and the circulator functions.

In a dielectric waveguide nonreciprocal circuit device such as the above circulator, it is important to make a structure in which magnetic members are supported while being disposed in specified positional relationships with a plurality of dielectric strips extending in different directions.

Japanese Unexamined Patent Publication No. 8-181509 and Japanese Unexamined Patent Publication No. 9-181506 each describe a circulator having a supporting member of a ring configuration or a cylindrical configuration. Japanese Unexamined Patent Publication No. 9-186507 describes a circulator in which the structure for supporting magnetic members is arranged on the dielectric strips by providing stepped portions at the edges of the dielectric strips.

The example shown in FIG. 11 uses the dielectric strips 3, 4, and 5, which are discrete components. However, as shown in FIGS. 12A and 12B, it is also possible to use a structure in which three dielectric strips 3, 4, and 5 are integrated with a supporting member for supporting magnetic members 6 and 7. In each of FIGS. 12A and 12B, reference numeral 10 denotes the supporting member, which is integrated with the dielectric strips 3, 4, and 5, for supporting the magnetic members 6 and 7.

However, the inventors of the present invention have investigated and discovered that, with the supporting member having a ring or cylindrical configuration, due to an influence of the dielectric constant of the supporting member, the insertion loss and reflection loss characteristics deteriorate, which causes a problem of degrading the nonreciprocal characteristics of the device.

SUMMARY OF THE INVENTION

Accordingly, it is an object of the present invention to provide a dielectric nonreciprocal circuit device capable of obtaining excellent nonreciprocal characteristics by improving the structure of a portion supporting a magnetic member, and to provide a radio device, incorporating the same.

As will be described below, in embodiments of this invention a supporting member for supporting the magnetic member has almost no influence on the nonreciprocal characteristics of the device, based on an analytical result which has determined that the electromagnetic field distribution is concentrated in a portion where the magnetic member is in contact with the dielectric strips and in portions near an upper conductive plate and a lower conductive plate.

According to one aspect of the present invention, there is provided a dielectric waveguide nonreciprocal circuit device including a magnetic member, a supporting member for supporting the magnetic member, an upper conductive plate and a lower conductive plate, and dielectric strips disposed in radial directions with respect to the magnetic member at the center of the arrangement, the dielectric strips disposed between the upper and lower conductive plates. In this structure, the supporting member is formed in such a way that the supporting member supports the magnetic member at locations other than where the magnetic member is abutted against the dielectric strips and where the magnetic member is disposed in close proximity to the dielectric strips.

With this arrangement, since no parts of the supporting member for supporting the magnetic member are provided where the magnetic member is in contact with the dielectric strips, which is a place where an electromagnetic field distribution is concentrated, the influence of the supporting member is reduced.

In addition, in the above dielectric waveguide nonreciprocal circuit device, edges or corners of the adjacent dielectric strips are connected to each other by the supporting member.

In addition, in the dielectric waveguide nonreciprocal circuit device described in the first aspect of the present invention, the magnetic member may be supported by the adjacent edges or corners of the dielectric strips, and the side walls of the dielectric strips may be connected to each other by a connecting member made of a dielectric material.

Furthermore, the magnetic member may be supported by the connecting member.

According to another aspect of the present invention, there is provided a radio device incorporating one of the above-described dielectric waveguide nonreciprocal circuit devices as a circulator formed by the dielectric transmission lines comprising dielectric strips. The circulator propagates a transmission signal and a reception signal, and performs branching of the transmission and reception signals.

According to another aspect of the present invention, there is provided a radio device incorporating an isolator formed by providing a terminating member on a predetermined dielectric transmission line comprising one of the dielectric strips in one of the above dielectric waveguide nonreciprocal circuit devices. The isolator blocks a reverse-propagation signal.

DESCRIPTION OF EMBODIMENTS OF THE INVENTION

Figure 8:
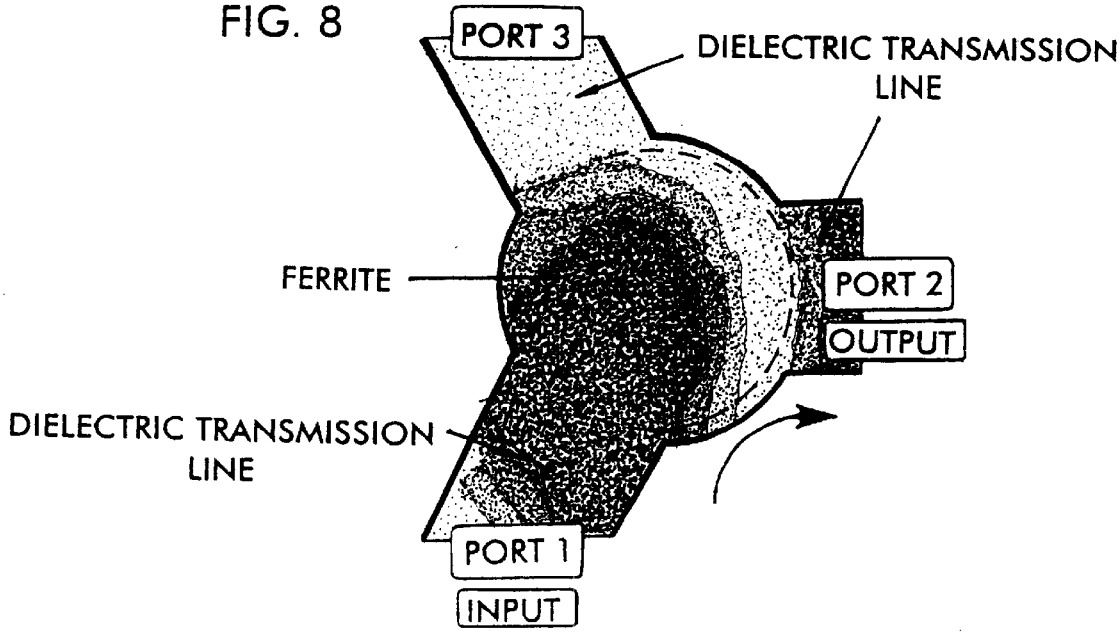
FIG. 8 is a view showing the distribution of a high-frequency magnetic field of a ferrite resonator in the proximity of the upper conductive plate of the circulator used in the present invention.

FIG. 8 shows a result obtained by electromagnetic analysis of a circulator having a magnetic member supported by a supporting member whose relative permittivity is zero. This figure illustrates the magnetic field distribution on a sectional surface parallel to an upper conductive plate, the surface being in proximity to the upper conductive plate. In FIG. 8, the broken-line indicates the position where a disk-shaped magnetic member made of a ferrite material is provided. In addition, the portions indicated as dielectric transmission lines in this figure are equivalent to the dielectric strips of an NRD waveguide. In this case, a signal propagates from Port 1 to Port 2. As shown here, it is found that the electromagnetic field distribution is concentrated in both the part where the magnetic member is in contact with the dielectric strips and the part in the vicinity of the conductive plate. According to the present invention the supporting member is located away from both the position where the magnetic member is in contact with the dielectric strips and the position where the magnetic member is close to the dielectric strips, which are places where an electromagnetic field is concentrated.

Figure 9A:
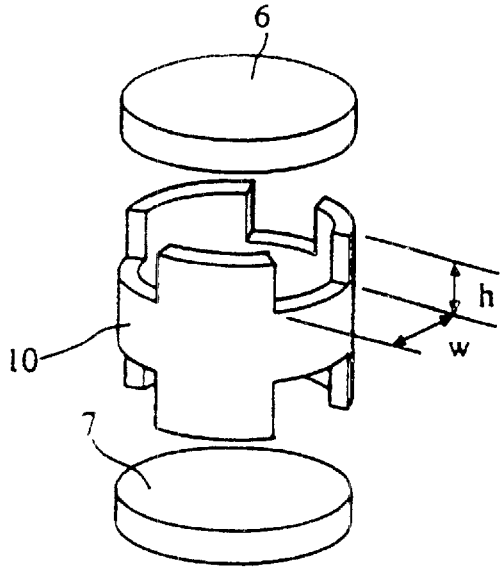
FIGS. 9A and 9B show the configuration of a supporting member and a graph of examples of the reflection characteristics obtained by the configuration thereof, respectively.
Figure 9B:
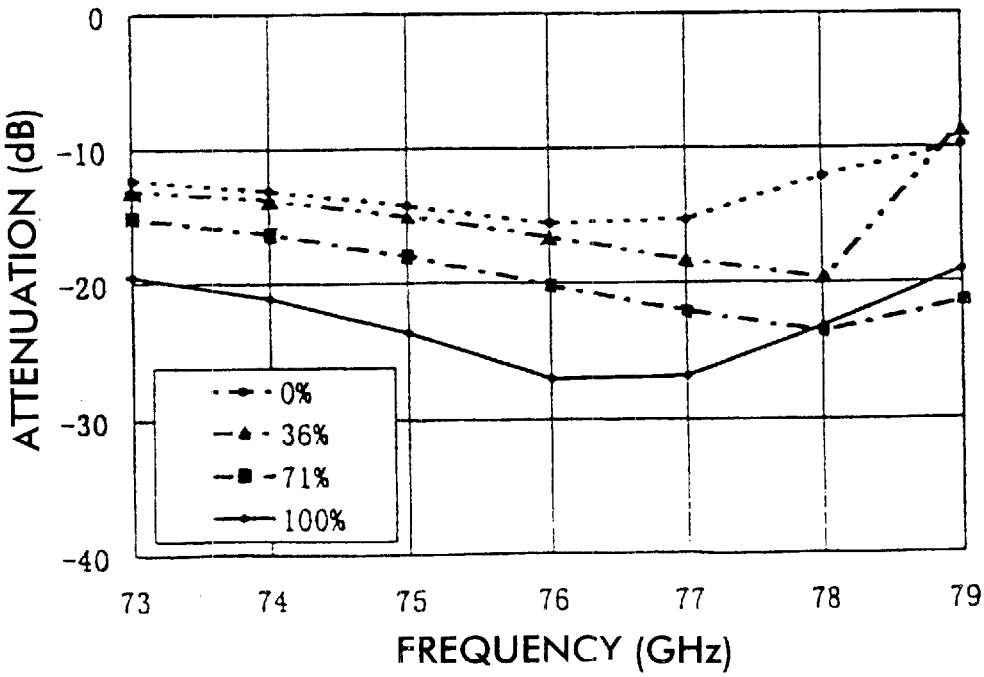

Considering the region in which the electromagnetic field distribution is concentrated, FIGS. 9A and 9B respectively illustrate the configuration of a supporting member 10 and the reflection-loss characteristics obtained by changing the configuration of the supporting member 10, which supports magnetic members 6 and 7. As shown in FIG. 9A, the width of an eliminated part, specifically a notch, of the supporting member 10 is indicated by w, and the depth of the eliminated part, 11 of notch, is indicated by h. The eliminated parts, or notches, of the supporting member 10 are provided to avoid the locations where the magnetic members 6 and 7 are abutted against the dielectric strips and the locations where the magnetic members 6 and 7 are close to the dielectric strips 3, 4, and 5. FIG. 9B illustrates reflection characteristics obtained when the depth h is changed by ½ of the width w of the dielectric strip. In this case, the depth h of the eliminated part is equivalent to the amount of elimination expressed as a percentage. For example, 0% indicates a state in which there are no eliminated parts. As seen in the figure, as the depth h of the eliminated part increases, the reflection decreases, which leads to improvement in the insertion loss and isolation characteristics.

Figure 1A:
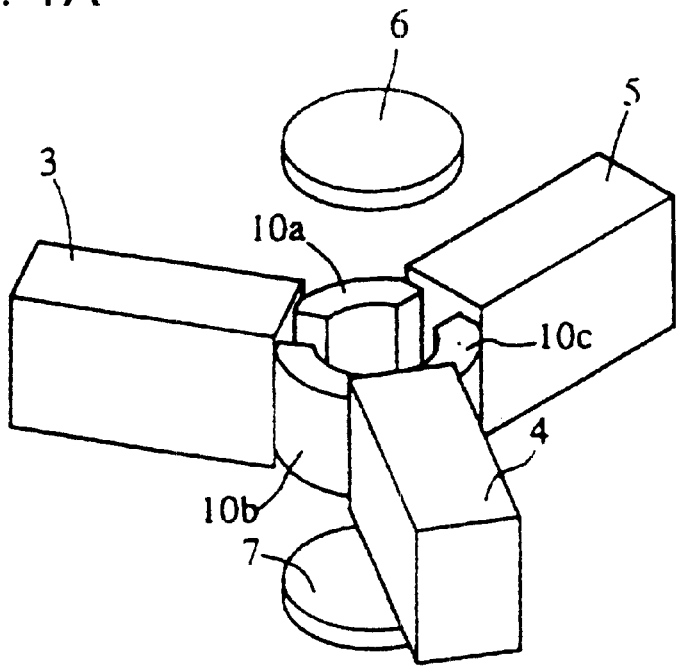
FIGS. 1A and 1B show an exploded perspective view and a plan view, respectively, illustrating the structure of the main part of a circulator according to a first embodiment of the present invention.
Figure 1B:
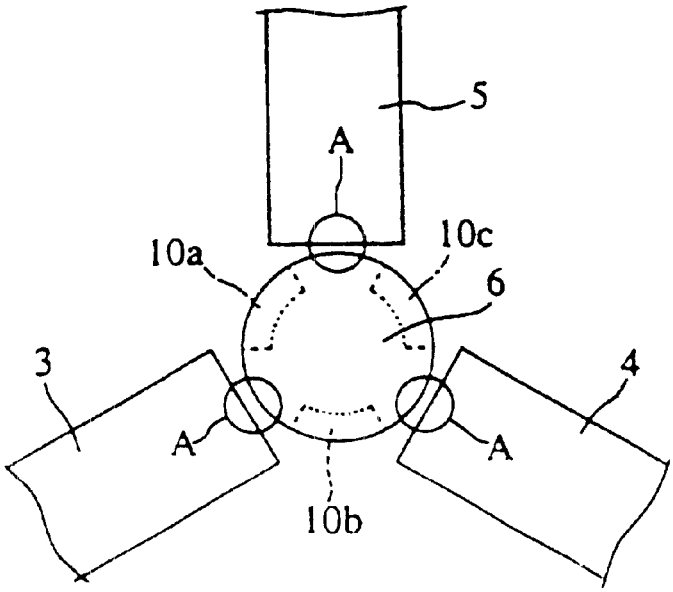

FIGS. 1A and 1B show the structure of the main part of a circulator according to a first embodiment of the present invention. FIG. 1A is a perspective view illustrating a state in which an upper conductive plate and a lower conductive plate are not shown, and an upper magnetic member 6 and a lower magnetic member 7 are separated from supporting members 10*a*, 10*b*, and 10*c*. In addition, FIG. 1B is a plan view showing the positional relationship between the magnetic members 6 and 7 and dielectric strips 3, 4, and 5.

In FIGS. 1A and 1B, reference numerals 3, 4, and 5, indicate dielectric strips, which are positioned between the upper conductive plate and the lower conductive plate, which are not shown, to form an NRD waveguide. In the NRD waveguide, the distance between the two opposing conductive plates in the propagation area of the NRD waveguide is set to be no more than half of the wavelength of a millimeter wave to be transmitted so as to block the propagation of an electromagnetic wave at parts where no dielectric strips are provided. Additionally, grooves are formed in the conductive plates for fitting the dielectric strips 3, 4, and 5 into the conductive plates so that the cut off frequency of an $LSM_{01}$ mode is lower than that of an $LSE_{01}$ mode. With the above arrangement, the distance between the conductive plane surfaces of the conductive plates in the non-propagation area is narrowed to propagate a single $LSM_{01}$ mode. This NRD waveguide will be hereinafter referred to as a hyper NRD waveguide.

One end of each of the three dielectric strips 3, 4, and 5 is oriented toward the center of the structure, and the dielectric strips 3, 4, and 5 are arranged such that the angle defined between the respective adjacent dielectric strips is 120°. The supporting members 10*a*, 10*b*, and 10*c* for supporting the magnetic members 6 and 7 are positioned to avoid the locations where the magnetic members 6 and 7 are abutted against the dielectric strips 3, 4, and 5, and the locations where the magnetic members 6 and 7 are close thereto. Although the supporting members 10*a*, 10*b*, and 10*c* and the dielectric strips 3, 4, and 5 may be separate as shown in FIG. 1A, when they are integrated, assembly of the device can be simplified and the positional precision of the positional relationships between the three dielectric strips 3, 4, and 5 and the magnetic members 6 and 7 can be improved. Such a structure can be integrally formed by injection molding or can be produced by cutting.

In FIG. 1B, the parts indicated by A correspond to positions at which the magnetic members 6 and 7 are abutted against the dielectric strips 3, 4, and 5, or positions at which the magnetic members 6 and 7 are disposed in close proximity to the dielectric strips 3, 4, and 5. The supporting members 10*a*, 10*b*, and 10*c* are not disposed in the parts indicated by A. With this arrangement, since the influence of the supporting members 10*a*, 10*b*, and 10*c* can be suppressed at the parts where the magnetic members are abutted against the dielectric strips or where the magnetic, members 6 and 7 are disposed in close proximity thereto, satisfactory insertion-loss characteristics and reflection-loss characteristics between two predetermined ports can be obtained. As a result, the isolation characteristics can be improved.

Figure 2:
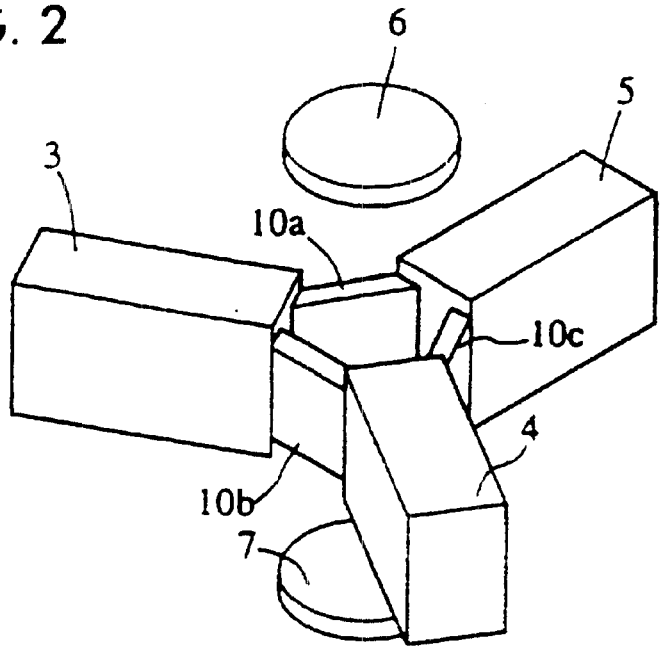
FIG. 2 is a perspective view of the main part of a circulator according to a second embodiment of the present invention.

FIG. 2 is a perspective view illustrating the structure of the main part of a circulator according to a second embodiment. In FIGS. 1A and 1B, the configurations of the supporting members 10*a*, 10*b*, and 10*c*, define parts of cylindrical surfaces in accordance with the shapes of the magnetic members 6 and 7. However, as shown in FIG. 2, the supporting members 10*a*, 10*b*, and 10*c* may simply have the configurations of plates.

Figure 3:
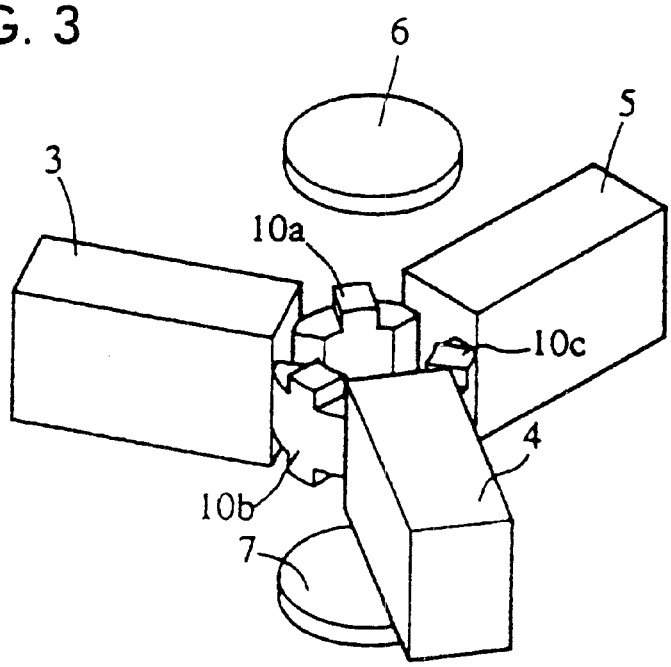
FIG. 3 is a perspective view of the main part of a circulator according to a third embodiment of the present invention.

FIG. 3 is a perspective view illustrating the structure of the main part of a circulator according to a third embodiment of the present invention. In FIGS. 1A and 1B, the upper and lower surfaces of the supporting members 10*a*, 10*b*, and 10*c* connecting the edges of the adjacent dielectric strips 3, 4, and 5 have fixed and uniform heights. However, as shown in FIG. 3, only the middle portions of the supporting members 10*a*, 10*b*, and 10*c* disposed between the adjacent dielectric strips 3, 4, and 5 protrude upward toward the magnetic members 6 and 7. With this arrangement, since the magnetic members 6 and 7 can be supported only by the protruding portions in which the electromagnetic field distribution is not concentrated, the insertion-loss characteristics and the reflection-loss characteristics can be further improved.

Figure 4:
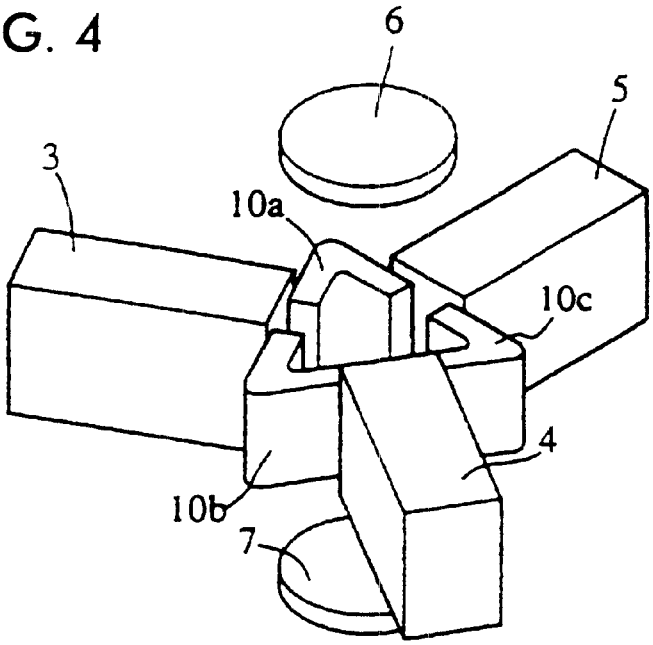
FIG. 4 is a perspective view of the main part of a circulator according to a fourth embodiment of the present invention.

FIG. 4 is a perspective view illustrating the structure of the main part of a circulator according to a fourth embodiment of the present invention. In the embodiments shown in FIGS. 1A to 3, either the configurations of the supporting members 10*a*, 10*b*, and 10*c* correspond to the external dimensions of the magnetic members 6 and 7, or the supporting members 10*a*, 10*b*, and 10*c* are disposed in an area smaller than the external dimensions thereof. However, as shown in FIG. 4, the dimensions of the supporting members 10*a*, 10*b*, and 10*c* may be larger than the external dimensions of the magnetic members 6 and 7. That is, the supporting members 10*a*, 10*b*, and 10*c* may extend outside the external dimensions thereof.

Figure 5:
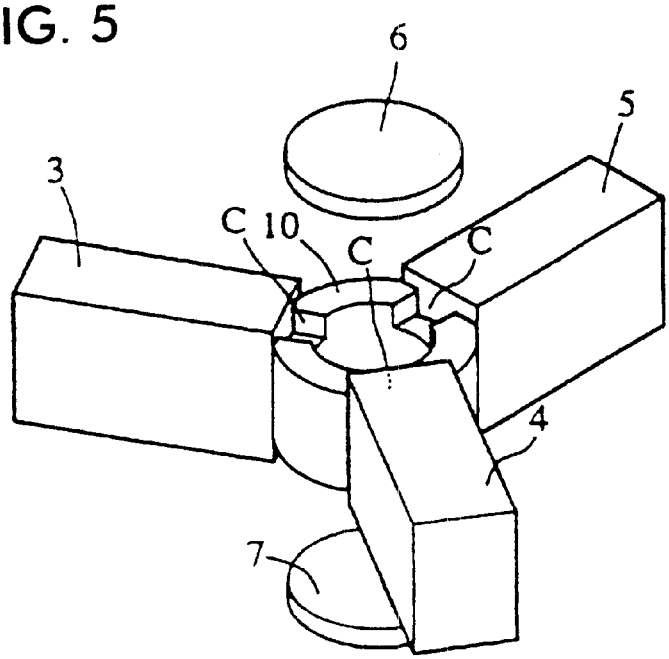
FIG. 5 is a perspective view of the main part of a circulator according to a fifth embodiment of the present invention.

FIG. 5 is a perspective view illustrating the structure of the main part of a circulator according to a fifth embodiment of the present invention. Unlike the three supporting members 10*a*, 10*b*, and 10*c* in the embodiment shown in FIGS. 1A and 1B, which are separate and are disposed between the edges of the adjacent dielectric strips 3, 4, and 5, the embodiment shown in FIG. 5 has an arrangement such that a cylindrical supporting member 10 is integrated to the respective end of the three dielectric strips 3, 4, and 5, and notches C, which are cut-away parts, are formed at three parts of the supporting member 10 in the axial direction of the supporting member 10. The axial direction thereof is a direction perpendicular to an upper conductive plate and a lower conductive plate, which are not shown in FIG. 5. FIGS. 1A and 1B show the state in which the size of each of the notches C is at a maximum. In FIG. 5, the notches are less deep than in FIGS. 1A and 1B.

Figure 6A:
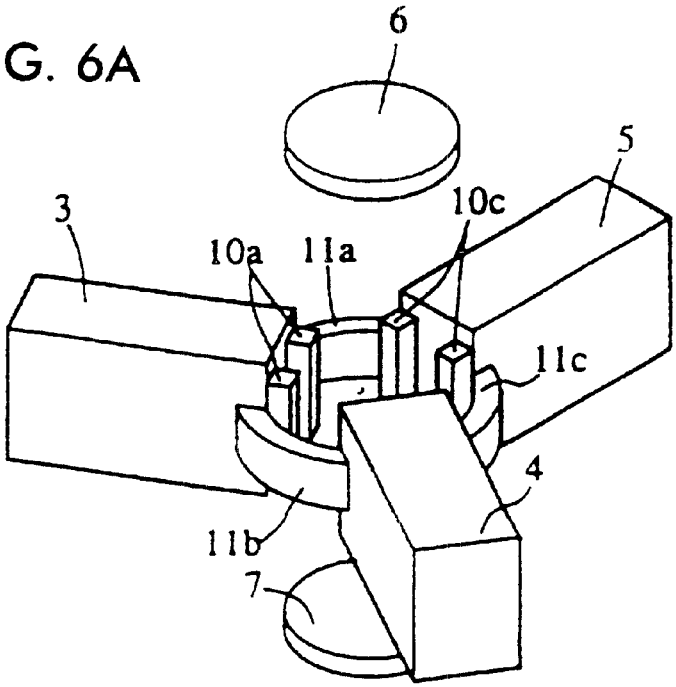
FIGS. 6A and 6B show perspective views of the main parts of circulators according to a sixth embodiment of the present invention.
Figure 6B:
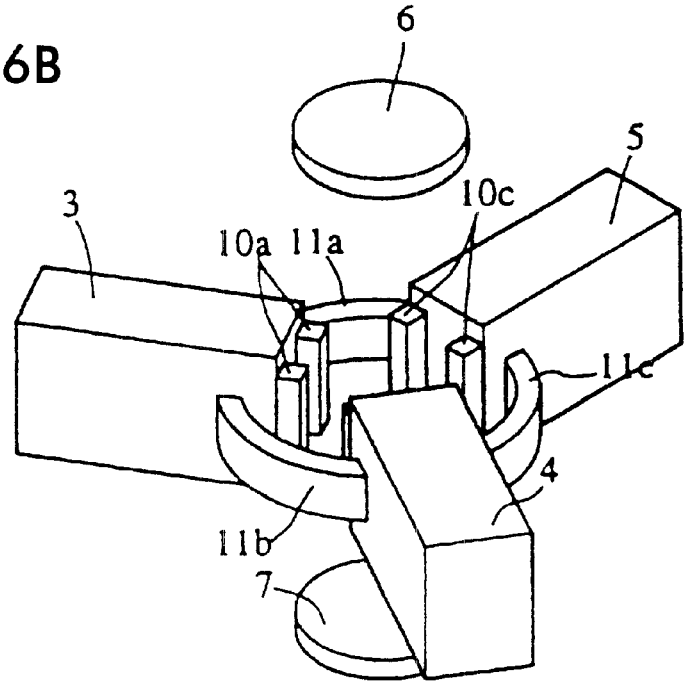

FIGS. 6A and 6B are perspective views illustrating the structure of the main part of a circulator according to a sixth embodiment of the present invention. The supporting members 10*a*, 10*b*, and 10*c* used in each of the embodiments shown in FIGS. 2 to 5 have configurations connecting the edges of the adjacent dielectric strips 3, 4, and 5. However, as shown in FIGS. 6A and 6B, the side walls of the adjacent dielectric strips 3, 4, and 5 may instead be integrally connected by connecting members 11*a*, 11*b*, and 11*c* made of a dielectric material. Furthermore, supporting members 10*a*, 10*b*, and 10*c*, may protrude from the ends of the dielectric strips 3, 4, and 5. The magnetic members 6 and 7 are supported by the supporting members protruding from the dielectric strips. FIG. 6A is an embodiment in which the connecting members 11*a*, 11*b*, and 11*c* are disposed on the side walls near the ends of the dielectric strips 3, 4, and 5, and FIG. 6B is an embodiment in which the connecting members 11*a*, 11*b*, and 11*c* are disposed on the side walls while being slightly distant from the ends thereof.

As in the cases of the above embodiments, this structure can be integrally formed by injection molding or can be produced by cutting. As described here, with integral formation of the three dielectric strips 3, 4, and 5 and the supporting members 10*a*, 10*b*, and 10*c* for supporting the magnetic members, assembly of the device can be simplified and the precision of the positional relationships between the three dielectric strips 3, 4, and 5 and the magnetic members 6 and 7 is improved.

Figure 7:
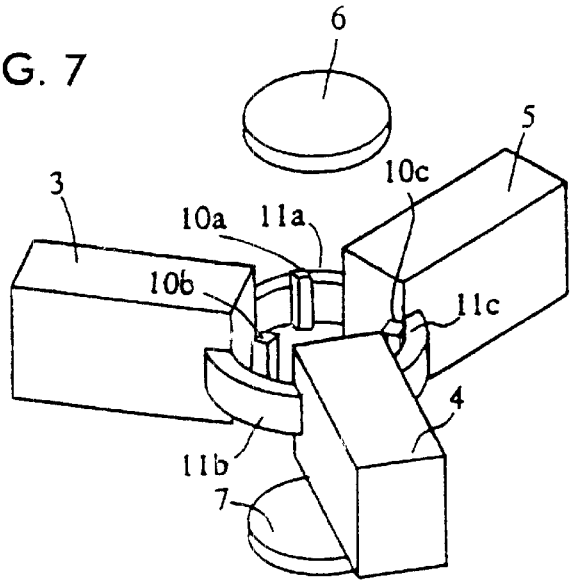
FIG. 7 is a perspective view of the main part of a circulator according to a seventh embodiment of the present invention.

FIG. 7 is a perspective view illustrating the structure of the main part of a circulator according to a seventh embodiment of the present invention. Unlike the embodiments shown in FIGS. 6A and 6B which have the supporting members 10*a*, 10*b*, and 10*c* for supporting the magnetic members 6 and 7 disposed at the edges of the dielectric strips 3, 4, and 5, the supporting members 10*a*, 10*b*, and 10*c* may instead be integrally formed at the middle positions of the connecting members 11*a*, 11*b*, and 11*c* connecting the adjacent dielectric strips 3, 4, and 5, as shown in FIG. 7. With this arrangement, the supporting members can be greatly separated from the areas in which the electromagnetic field distribution is concentrated.

Figure 10:
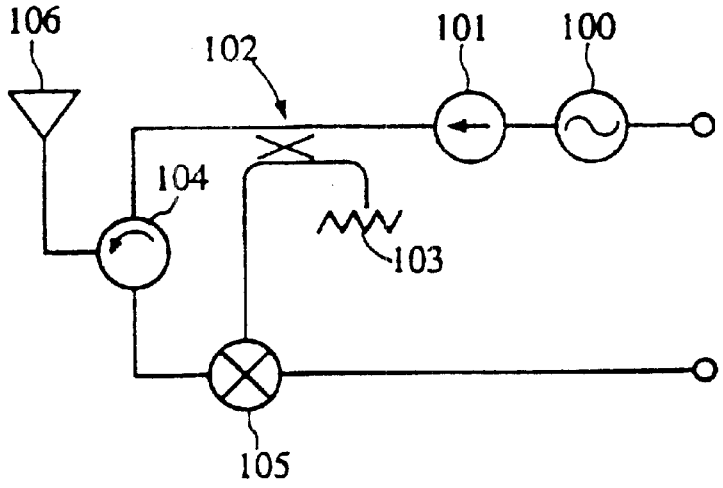
FIG. 10 is a block diagram of a millimeter wave radar RF module.
Figure 11:
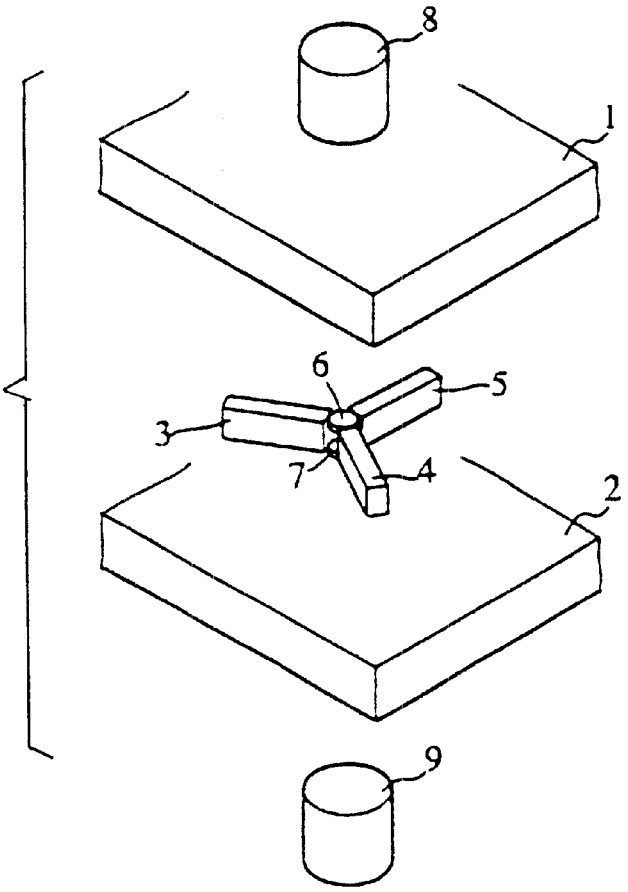
FIG. 11 PRIOR ART
FIG. 11 is an exploded perspective view illustrating the structure of a conventional circulator.
Figure 12A:
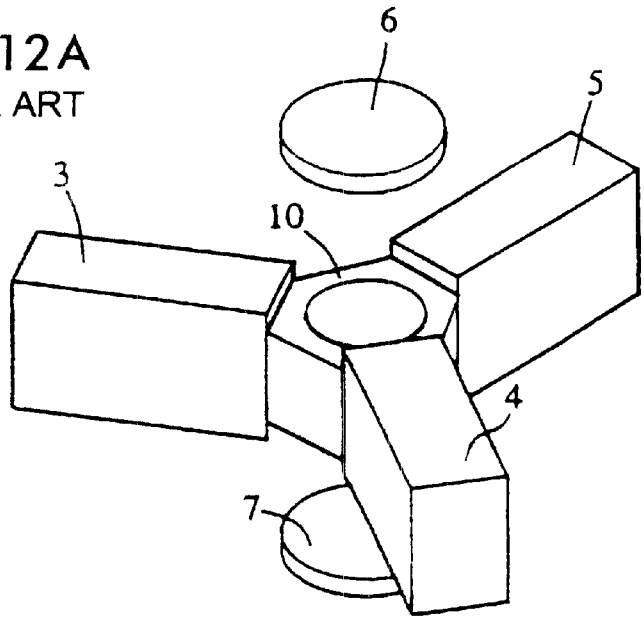
FIG. 12A PRIOR ART
FIGS. 12A and 12B show exploded perspective views illustrating the structures of conventional circulators.
Figure 12B:
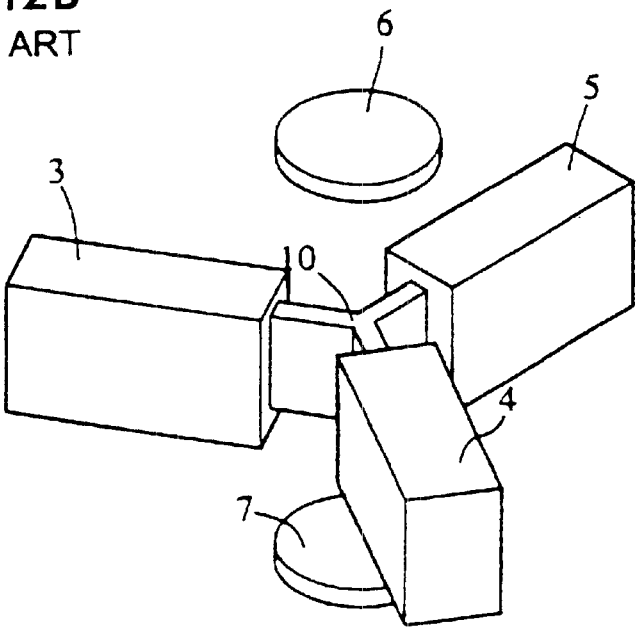
FIG. 12B PRIOR ART

Next, an embodiment in which the present invention is applied to a millimeter wave radar module will be illustrated by referring to FIG. 10.

FIG. 10 is a block diagram of a millimeter wave radar RF module. This module substantially comprises an oscillator 100, an isolator 101, a coupler 102, a terminating unit 103, a circulator 104, a mixer 105, and a primary radiator 106. These units are connected by the transmission line of a hyper NRD waveguide. The oscillator 100 includes a Gunn diode and a varactor diode, and outputs an oscillation signal to the input port of the isolator 101. The isolator 101 comprises another circulator and another terminating unit which is connected to a port at which the reflection signal of said other circulator is received. This circulator has the structure shown in one of the above-described embodiments. The coupler 102 obtains a local signal Lo by disposing two dielectric strips close together. One port of the coupler 102 is terminated by the terminating unit 103. The circulator 104 outputs a transmission signal to the primary radiator 106, and outputs a reception signal from the primary radiator 106 to the mixer 105. The mixer 105 mixes the reception signal with the Lo signal to obtain an IF signal, that is, an intermediate frequency signal.

A controller of the above millimeter wave radar module controls, for example, the oscillation frequency of the oscillator 100 by an FM-CW system, and in addition, signal-processing of the IF signal is performed so that the distance from a target to be detected and the relative velocity of the target are obtained.

In each of the above-described embodiments, a hyper NRD waveguide is used as the dielectric waveguide. However, a normal NRD waveguide can also be used. In the normal NRD waveguide, the distance between the opposing conductive plates is set to be no more than half of the wavelength of a millimeter wave to be transmitted so as to block the propagation of an electromagnetic wave in areas in which no dielectric strips are located. Furthermore, the dielectric waveguide used in the present invention is not restricted to a nonradiative dielectric waveguide, and a simple dielectric waveguide may be used.

Additionally, in each of the embodiments described above, the circulator having three ports is used as a nonreciprocal circuit device. The present invention, however, is not limited to this case, and can be generally applied to any device with a nonreciprocal circuit characteristic by using the ferrimagnetic characteristics of the magnetic member, comprising a supporting member for supporting a magnetic member and dielectric strips arranged in radial directions with respect to the supporting member at the center of the structure, the dielectric strips being located between an upper conductive plate and a lower conductive plate.

Furthermore, although each embodiment described has magnetic members disposed in the proximity of both surfaces where the upper and lower conductive plates contact the dielectric strips, a magnetic member may be disposed near only one of the surfaces. The shape of the magnetic member is not restricted to a disk. For example, the magnetic member may have a polygonal shape, and furthermore, as an alternative to a plate shape, a columnar, prism or pillar shape having a greater thickness may be used.

As described above, according to the present invention, the supporting members for supporting the magnetic members are not provided at the part where the magnetic members are abutted against the dielectric strips and at the part where the magnetic members are disposed in close proximity to the dielectric strips, that is, at the parts in which the electromagnetic field distribution is concentrated. As a result, matching of the dielectric waveguide comprising the dielectric strips and the upper and lower conductive plates disposed thereon to the magnetic resonators comprising the magnetic members can be optimized, by which excellent nonreciprocal characteristics can be obtained. Accordingly, when the dielectric waveguide nonreciprocal circuit device of the present invention is used as a circulator, the insertion-loss characteristics and reflection-loss characteristics between the two ports can be improved, which leads to enhancement of the isolation characteristics.

In addition, according to the present invention, when the supporting members and the dielectric strips are either attached to each other or formed integrally, the relative locations of the plurality of the dielectric strips are well determined,so that the dimensional precision of positions at which the magnetic members are disposed with respect to the dielectric strips can be easily improved, and assembly of the device can also be facilitated.

Furthermore, according to the present invention, the circulator having good dielectric waveguide nonreciprocal circuit device characteristics can carry both a transmission signal and a reception signal and can branch the transmission and reception signals. As a result, a radio device such as a compact millimeter wave radar incorporating a dielectric waveguide can be easily produced.

Furthermore, according to the present invention, since the isolator having good dielectric waveguide nonreciprocal circuit device characteristics allows a reverse-propagation signal to be blocked, for example, a signal returning to the oscillator can be reliably blocked in the circuit having the dielectric strips as a signal-propagating path. Accordingly, a radio device having such good characteristics can be easily obtained.

While forms of the present invention have been described, it is to be understood that modifications will be apparent to those skilled in the art without departing from the spirit of the invention.

What is claimed is:

1. A dielectric waveguide nonreciprocal circuit device comprising:

a magnetic member;

supporting members for supporting the magnetic member;

an upper conductor plate and a lower conductor plate; and dielectric strips disposed with central ends thereof located adjacent to the magnetic member, and extending in radial directions with respect to the magnetic member, the dielectric strips being located between the upper and lower conductive plates;

wherein each of said supporting members is spaced away from locations defined between the magnetic member and the respective dielectric strips such that said supporting members support said magnetic member only at locations spaced away from said locations defined between the magnetic member and the respective dielectric strips.

2. A dielectric waveguide nonreciprocal circuit device according to claim 1, wherein edges of said central ends of the adjacent dielectric strips are connected by the supporting members.

3. A dielectric waveguide nonreciprocal circuit device according to claim 1, wherein the supporting members are protruding portions of said central ends of the dielectric strips and side walls of the dielectric strips are connected by connecting members made of a dielectric material.

4. A dielectric waveguide nonreciprocal circuit device according to claim 1, wherein side walls of the dielectric strips are connected by connecting members made of a dielectric material, and the magnetic member is supported by the connecting members.

5. A radio device comprising the dielectric waveguide nonreciprocal circuit device in accordance with one of claims 1 to 4 as a circulator, the radio device having dielectric transmission lines comprising the dielectric strips, the circulator carrying a transmission signal transmitted by said radio device and a reception signal received by said radio device, and performing branching of the transmission and reception signals.

6. A radio device comprising the dielectric waveguide nonreciprocal circuit device in accordance with one of claims 1 to 4 as an isolator, the radio device having dielectric transmission lines comprising said dielectric strips, a terminating unit on a predetermined one of said dielectric transmission lines, the isolator carrying a forward-propagation signal on one of said dielectric transmission lines and blocking a reverse-propagation signal thereon.

7. A dielectric waveguide nonreciprocal circuit device according to claim 1, wherein said supporting members are substantially planar.

8. A dielectric waveguide nonreciprocal circuit device according to claim 1, wherein said supporting members are substantially curved.

9. A dielectric waveguide nonreciprocal circuit device according to claim 1, wherein said supporting members have portions protruding toward said magnetic member and said protruding portions are disposed substantially away from said locations defined between the magnetic member and the respective dielectric strips.

10. A dielectric waveguide nonreciprocal circuit device according to claim 9, wherein said magnetic member is supported substantially only by said protruding portions.

11. A dielectric waveguide nonreciprocal circuit device according to claim 1, wherein said supporting members have eliminated portions at locations between the magnetic member and the respective dielectric strips.

12. A dielectric waveguide nonreciprocal circuit device comprising:

a magnetic member;

supporting members for supporting the magnetic member;

an upper conductive plate and a lower conductive plate; and dielectric strips disposed with central ends thereof located near the magnetic member, and extending in radial directions with respect to the magnetic member, the dielectric strips being located between the upper and lower conductive plates;

wherein each supporting member is disposed substantially away from locations defined between the magnetic member and the respective dielectric strips;

wherein said supporting members have eliminated portions at locations between the magnetic member and the respective dielectric strips; and wherein said eliminated portions are notches.

13. A dielectric waveguide nonreciprocal circuit device according to claim 12, wherein said supporting members have portions protruding toward said magnetic member and said protruding portions are disposed substantially away from said locations defined between the magnetic member and the respective dielectric strips; and said magnetic member is supported substantially only by said protruding portions.

14. A dielectric waveguide nonreciprocal circuit device comprising:

a magnetic member;

a single supporting member for supporting the magnetic member;

an upper conductor plate and a lower conductor plate; and dielectric strips disposed with central ends thereof located adjacent to the magnetic member, and extending in radial directions with respect to the magnetic member, the dielectric strips being located between the upper and lower conductive plates;

wherein said supporting member supports said magnetic member only at a plurality of locations spaced away from locations defined between the magnetic member and the respective dielectric strips.

15. A dielectric waveguide nonreciprocal circuit device according to claim 14, wherein said supporting member is connected to the respective central ends of said dielectric strips.

16. A dielectric waveguide nonreciprocal circuit device according to claim 14, wherein said supporting member has portions protruding toward said magnetic member and said protruding portions are disposed substantially away from said locations defined between the magnetic member and the respective dielectric strips; and said magnetic member is supported substantially only by said protruding portions.

17. A dielectric waveguide nonreciprocal circuit device according to claim 16, wherein said protruding portions are defined by notches formed in portions of said supporting member adjacent to said magnetic member.

18. A dielectric waveguide nonreciprocal circuit device according to claim 14, wherein said supporting member has portions protruding toward said magnetic member and said protruding portions are disposed substantially away from said locations defined between the magnetic member and the respective dielectric strips.

19. A dielectric waveguide nonreciprocal circuit device according to claim 18, wherein said protruding portions are defined by notches formed in portions of said supporting member adjacent to said magnetic member.

* * * * *